US012098601B2

(12) United States Patent
Akhare

(10) Patent No.: US 12,098,601 B2
(45) Date of Patent: Sep. 24, 2024

(54) WELDLESS DRILLING DIVERTER ADAPTER

(71) Applicant: Worldwide Oilfield Machine, Inc., Houston, TX (US)

(72) Inventor: Prashant N Akhare, Cypress, TX (US)

(73) Assignee: Worldwide Oilfield Machine, Inc., Houston, TX (US)

( * ) Notice: Subject to any disclaimer, the term of this patent is extended or adjusted under 35 U.S.C. 154(b) by 0 days.

(21) Appl. No.: 17/981,869

(22) Filed: Nov. 7, 2022

(65) Prior Publication Data

US 2023/0151702 A1 May 18, 2023

Related U.S. Application Data

(60) Provisional application No. 63/280,341, filed on Nov. 17, 2021.

(51) Int. Cl.
*E21B 19/10* (2006.01)

(52) U.S. Cl.
CPC ..... *E21B 19/10* (2013.01)

(58) Field of Classification Search
CPC ..... E21B 33/0422; E21B 33/04; E21B 33/03; E21B 33/038; E21B 33/02
See application file for complete search history.

(56) References Cited

U.S. PATENT DOCUMENTS 3,025,083 A * 3/1962 Lebeaux ..... E21B 33/047 166/97.5
3,334,923 A * 8/1967 Putch ..... E21B 33/043 166/348
3,711,123 A * 1/1973 Arnold ..... F16L 7/02 285/123.6
4,143,880 A * 3/1979 Bunting ..... F16J 15/40 277/927
4,235,021 A * 11/1980 Claycomb ..... E21B 47/0236 33/307
4,384,726 A * 5/1983 Meyer ..... F16J 15/20 277/516
4,799,714 A * 1/1989 Collet ..... E21B 33/0422 285/308
4,936,382 A * 6/1990 Thomas ..... E21B 33/0422 285/123.5
2003/0042027 A1* 3/2003 Lang ..... E21B 33/0422 166/382
2004/0173348 A1* 9/2004 Kwasniewski ..... E21B 33/0422 166/85.1
2019/0316725 A1* 10/2019 McGarian ..... E21B 33/03

* cited by examiner

*Primary Examiner* — Kipp C Wallace
(74) *Attorney, Agent, or Firm* — Kenneth L. Nash; Thomas D. Nash

(57) ABSTRACT

A weldless adapter is mountable to a conductor casing for pressure testing seals or initial drilling at a well site. Slips engage the conductor casing to latch the weldless adapter onto the casing. Pressure injection ports are utilized to activate two seal rings against the conductor casing using positive sealing. A test port is utilized to test the seals of the two seal rings. The slips are activated by three sets of bolts.

16 Claims, 6 Drawing Sheets

WELDLESS DRILLING DIVERTER ADAPTER

BACKGROUND

The present invention relates generally to adapters for conductor pipe, more particularly, to an improved weldless adapter for mechanical hook-up to conductor pipe.

Adapters for conductor pipe are used in the oilfield and may be welded or weldless to facilitate pressurized connections to conductor pipe. The design and size of adapters limits the maximum wellbore working pressure as well as the time and energy necessary to install and utilize adapters at a plurality of well sites. An adapter may be used for pressure testing seals on conductor casing at the wellhead. Welded adapter casings require increased resources and downtime to mount or remove compared to weldless adapters.

SUMMARY OF THE INVENTION

An objective of the present invention is to provide an improved weldless adapter assembly for conductor pipe 20 inch diameter or less.

Another objective of the present invention is to provide a weldless adapter operable to latch on to conductor casing to allow for pressure testing and drilling.

Yet another object of the present invention is to provide a weldless adapter that can easily be installed, removed, and moved to another conductor casing well site.

Another object of the present invention is to provide a weldless adapter with pressurized seals to allow for testing on the conductor.

Still another object of the present invention is to provide a weldless adapter that may be slipped onto a conductor and attached by slips contracting onto the conductor casing.

Yet another object of the present invention is to provide a method to test seals that operate in all ranges of temperature, pressure, and types of fluid that are encountered in oilfield applications.

These and other objects and advantages may or may not be used depending on the various possible embodiment of the invention.

One general aspect includes a weldless adapter operable for attachment to a conductor casing. The weldless adapter also includes an adapter body. The adapter body defines a bore therethrough. The adapter also includes an adapter body which may include a body cavity. The body cavity defines a slip cavity. A plurality of slip segments is mounted within the slip cavity and positioned for engagement with the conductor casing. The adapter also includes the body cavity which may include two seal recesses. The adapter includes two seals mounted in the two seal recesses where the two seals are positioned to seal around the conductor casing. The adapter has a body cavity defining two injection ports in fluid communication with the two seal recesses. Two injection fittings are mounted in the two injection ports. The two injection ports receive pressurized fluid to energize the two seals for sealing around the conductor casing. A test port is positioned between the two seals. The test port is in communication with an annulus formed between the two seals and the conductor casing. The adapter also includes a test fitting mounted to the test port.

The weldless adapter may include a plurality of slip actuator bolts mounted along a periphery of the adapter body within receptacles through the adapter body where the plurality of slip actuator bolts engages the slip segments. A plurality of jack bolts is arranged along a circumference of the bottom of the adapter body when the adapter body is mounted for operation. The plurality of jack bolts fit within receptacles along the bottom of the adapter body, the plurality of jack bolts engages the slip segments. The slip actuator bolts and the jack screws bolts urge the slip segments into the conductor casing during latching the weldless adapter to the conductor casing and to retract the slip segments when releasing the weldless adapter from the conductor casing. The weldless adapter may include a test port for receiving pressurized fluid between the two seals to provide a pressurized test of the two seals. The slip segments may be constructed with teeth along an inner wall of the slip segments relative the adapter body. The teeth bite into the conductor casing when latching the weldless adapter to the conductor casing and retracting when releasing the weldless adapter from the conductor casing.

One general aspect includes a method of providing a weldless adapter operable for attachment to a conductor casing. The method includes mounting an adaptor body onto the conductor casing. Grease is injected to activate two seal rings around the conductor casing. Grease is also injected into an annulus between the two seal rings and the conductor casing to test the two seal rings.

The method may include supporting the adaptor body on the conductor casing on a shoulder formed within the adaptor body. Bolts above and below a plurality of slip segments may be utilized for tightening and releasing the plurality of slip segments against the conductor casing. At least one of the bolts above and below the slip segments may be utilized for centralizing the adaptor body on the conductor casing. To activate the two seal rings, grease may be injected through two injector ports. The plurality of slip actuator bolts engages the plurality of slip segments. A plurality of jack screws bolts is arranged along the circumference of the bottom of the adapter body. The plurality of jack bolts fits within receptacles along the bottom of the adapter body. The plurality of jack bolts engages the plurality of slip segments. The body cavity may define two bleeder ports in fluid communication with the two seal recesses. Two bleeder fittings may be mounted to the two bleeder ports.

One general aspect includes a weldless adapter operable for attachment to a conductor casing. The weldless adapter also includes an adapter body. The adapter also includes a plurality of slip segments mounted in the adapter body. A first plurality of bolts is along a periphery of the adapter body to engage an upper portion of the plurality of slip segments. A second plurality of bolts is mounted to engage a lower portion of the plurality of slip segments.

The weldless adapter may include a third plurality of bolts mounted to engage the plurality of slip segments. The third plurality of bolts may be positioned between the first plurality of bolts and the second plurality of bolts. The weldless adapter may include the adapter body defining a bore therethrough. The bore may define a first axis. The plurality of slip segments may have an angled surface relative the first axis. The angled surface is adjacent the adapter body and may define a second axis. The third plurality of bolts may move axially along the second axis. The second plurality of bolts may move axially along the first axis.

The plurality of slip segments may be constructed with teeth on an inner side of the plurality of slip segments relative the adapter body for engagement with the conductor casing. The adapter body may define a body cavity. The body cavity may include two seal recesses. Two seals may be mounted in the two seal recesses where the two seals are positioned to seal around the conductor casing. The body cavity has two injection ports in fluid communication with the two seal recesses. Two injection fittings are mounted in the two injection ports. The two injection ports receive pressurized fluid to energize the two seals for sealing around the conductor casing. The body cavity has two bleeder ports in fluid communication with the two seal recesses. Two bleeder fittings are mounted to the two bleeder ports. A test port is positioned between the two seals. The test port is in communication with an annulus formed between the two seals and the conductor casing. A test fitting is mounted to the test port.

The weldless adapter may include the adapter body defining a bore therethrough. The bore may define a first axis. The plurality of slip segments may have an angled surface relative to the first axis. The angled surface is adjacent the adapter body which may define a second axis. The first plurality of bolts may move axially along the second axis. The second plurality of bolts operable may move axially along the first axis.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

BRIEF DESCRIPTION OF THE DRAWINGS

The following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The weldless adapters described below comply with the latest edition of API 6A and API 16A and has fully implemented API Q1 quality system.

The API 16A license applies to drill-through equipment. Products are designed to NACE MR-01-75 materials standards for resistance to sulfide stress cracking.

The weldless adapter permits mechanical hook-up to the conductor eliminating welding while providing a fully pressurized integral connection on top of the conductor pipe.

This adapter is designed to be used with 20" or s a ler O.D. pipe. However, the invention is not intended to be limited to a particular size. However, the maximum rated wellbore working pressure of this adapter is limited by the working pressure of the top connection (usually a flange) or the working pressure of the conductor pipe.

The actual maximum working pressure of the weldless adapter when installed on the conductor pipe should not exceed two-thirds (0.666) of the internal yield pressure of the pipe or the working pressure of the top connection, whichever is less, in other words, use the smallest number as the maximum working pressure of the adapter.

Internal metal-to-metal engagement slips 6 are mechanically activated for frictional engagement with the conductor 42. Seal pressurization is accomplished by hydraulic activation of rubber seals 4.

The use of the weldless adapter results in a significant time savinas. As the conductor is being installed, the diverter can be nippled up to the weldless adapter and the complete unit can be lowered onto the conductor at the appropriate time.

Figure 1A:
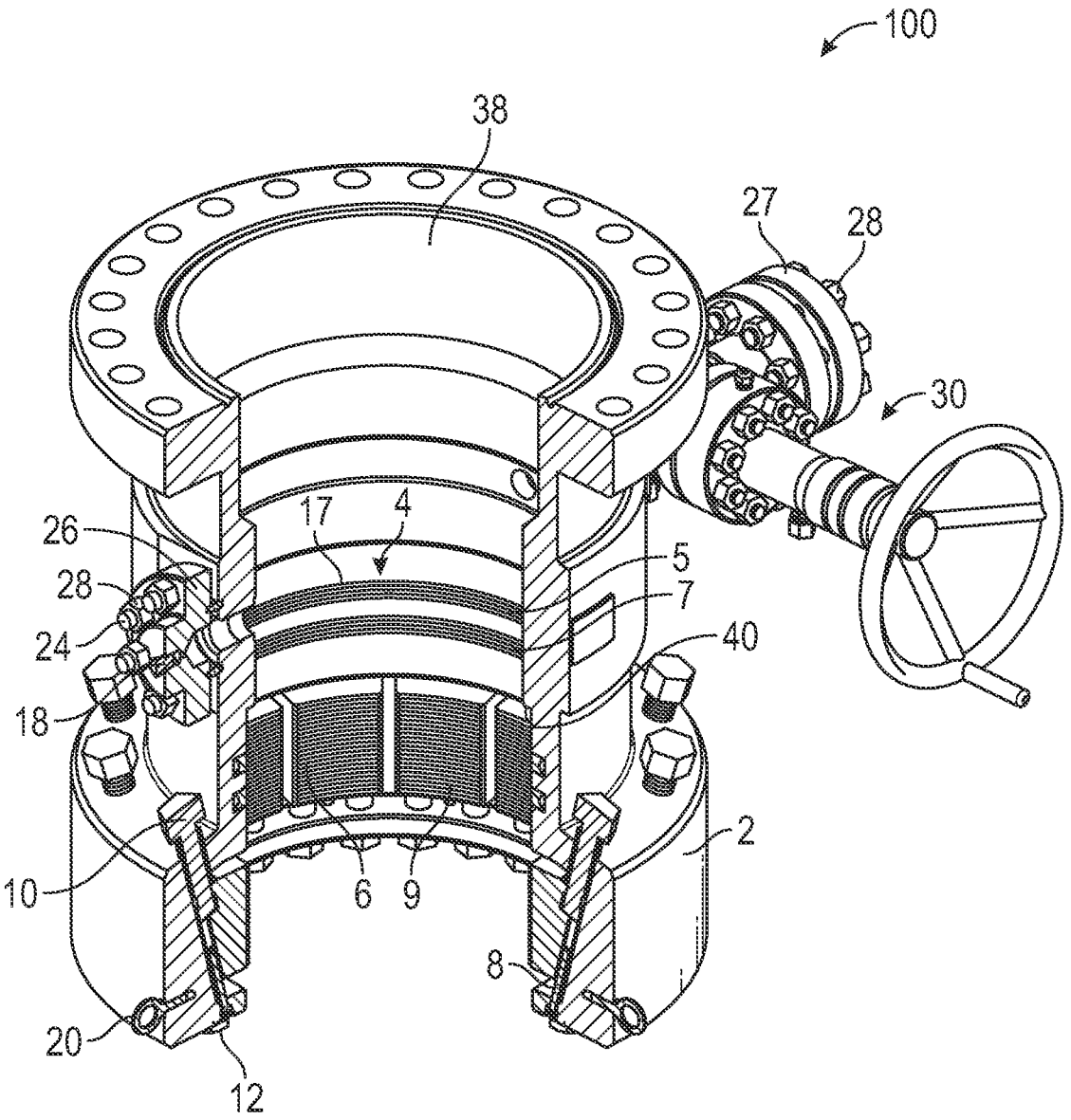
FIG. 1A is a perspective view in partial section of a weldless adapter in accord with one embodiment of the present invention.
Figure 1B:
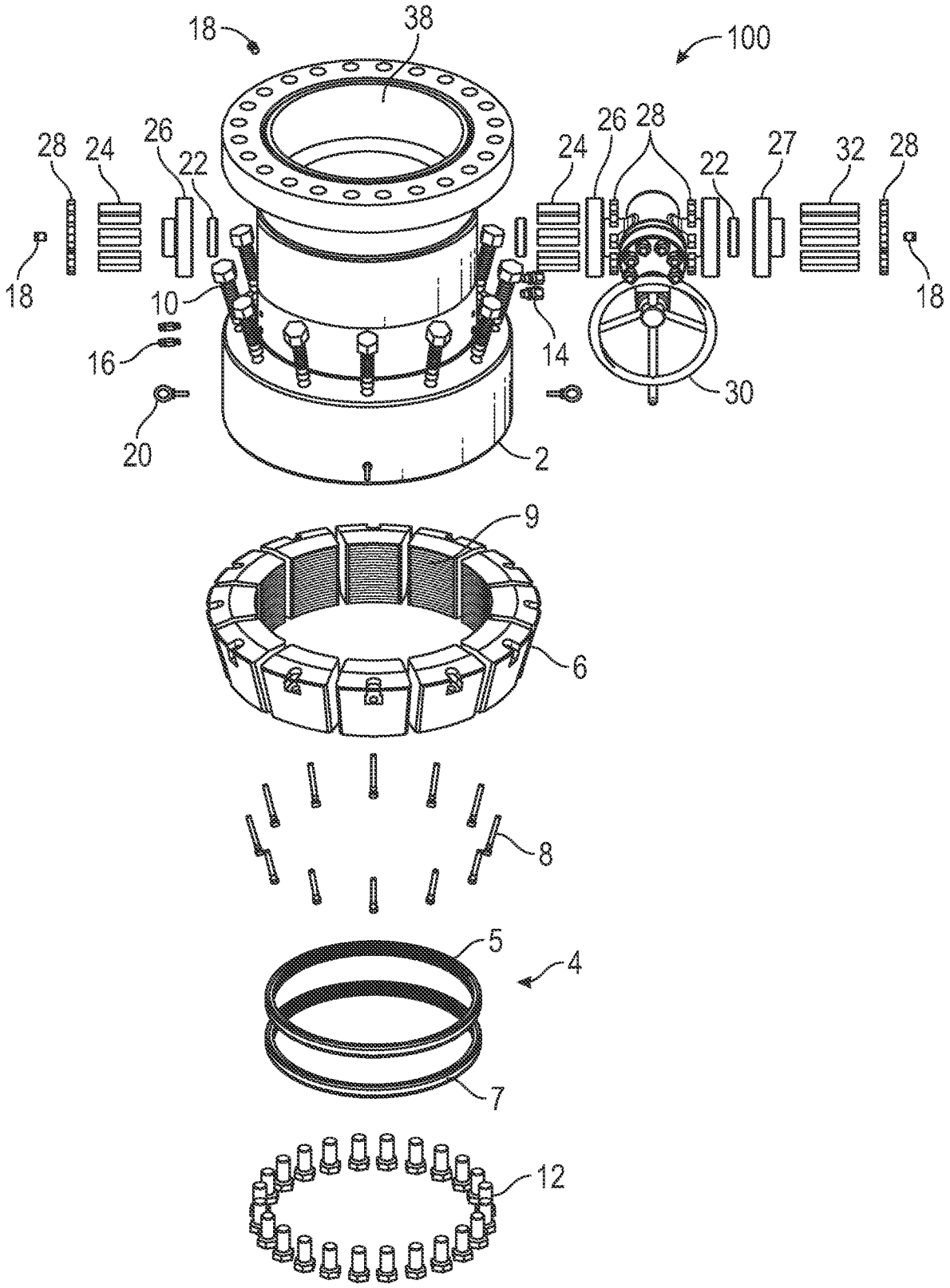
FIG. 1B is an exploded view of a weldless adapter in accord with one embodiment of the present invention.

Now referring to FIG. 1A-1B, wherein various views are shown of weldless adapter 100. Weldless adapter 100 comprises a body 2 with a body cavity 38. Body 2 may be constructed of metal suitable to withstand pressures necessary for operation in well operations. Within the body cavity is at least one seal 4. In the preferred embodiment, two seals 4 are used, one upper 5 and one lower seal 7. The seals 4 encircle the entire body cavity. Below the seals 4 within the body cavity 38, are slips 6 arranged around the perimeter. Slips 6, comprise teeth or grooves 9, which engage slip actuator bolts 10 located around the perimeter of the body 2 and are operable to engage the body Wall to contact the teeth or grooves in slips 6. Slip retainer bolts 8 are located below slip actuator bolts 10 and above jack screw 12. In one possible embodiment, slip retainer bolts 8 may be moveable by engagement from hex head cap screws 12 which may also be referred to as cap screws or jack up screws or bolts. However, in another possible embodiment the slip retainer bolts 8 may be moveable without engagement of the jack bolts 12 and slip actuator bolts 10 thereby could be moveable independently. Jack up screws 12 are located at the bottom of the body 2 of adapter 100.

Additionally, in one possible embodiment, slip retainer bolts 8 may be angled relative to jack screws 12. In another possible embodiment, slip actuator bolts 10 may be angled relative jack screws 12. In yet another possible embodiment, both slip retainer bolts 8, actuator bolts 10, and jack screws 12 may all be at different angles relative to each other. In one possible embodiment, the retainer bolts 8 and/or the actuator bolts 10 may move along a different or second axis 46 (See FIG. 7) than the jack bolts 12. In yet a further possible embodiment, retainer bolts 8, actuator bolts 10, and jack bolts 12 may all move axially along different axis or a combination thereof.

Additional components may be mounted on adapter 100 such as gate valve 30 which may be secured to flanges 26, 27 nuts or fasteners 28, and stud tap ends 24. Ring gaskets 22 along with stud bolts 32 may also be used to mount components to gate valve 30. Other valves or components may be mounted to the adapter 100 as well such as diverters or medium service pressure devices. Plugs 18 may be used to seal and cover valves or other like devices attached to weldless adapter 100. Within the side of the body 2 along the seals 4 may be plugs (not shown) to retain and protect grease fittings as well as to assist to energize or de-energize the seals. Eye bolts 20 may be mounted to the body 2 to allow for lifting and lowering the adapter 100 into position.

After the conductor pipe is landed and cemented, the pipe or casing may be cut at the desired elevation. This can be done with either gas cutting equipment or high-pressure water cutters. The cut should be square With the casing to ensure that when the adapter is installed, the casing rests squarely on the inside shoulder 40 (See FIG. 7) of the adapter 100 as indicated along axis 44. In a preferred embodiment, the outer edge of the cut casing should be ground with a slight taper to ensure that the seals 4 are not damaged when the adapter 100 is installed on the casing. If the casing has a wall thickness greater than 1", a taper should be ground on the inside of the casing to ensure that drilling tools do not hang up on the exposed shoulder. If the casing is seam welded, the seam should be ground smooth twenty-four inches (24") down from the top of the casing. This ensures full contact between the slip segments 6 and the casing O.D. and assures the seal 4 engages a smoother surface for best seal contact.

In a preferred embodiment, fittings or ports 14,16 (See FIGS. 2-3) are mounted on each side of body 2 for grease to be directed to seals 4. Grease fittings 14 may also be referred to as injection ports that allow grease to be injected into or around the seals 4. Bleeder fittings 16, also referred to as bleeder ports, allow grease to exit as pressure builds to show a positive seal as well as to allow grease to be removed to depressurize the seals 4.

Figure 2:
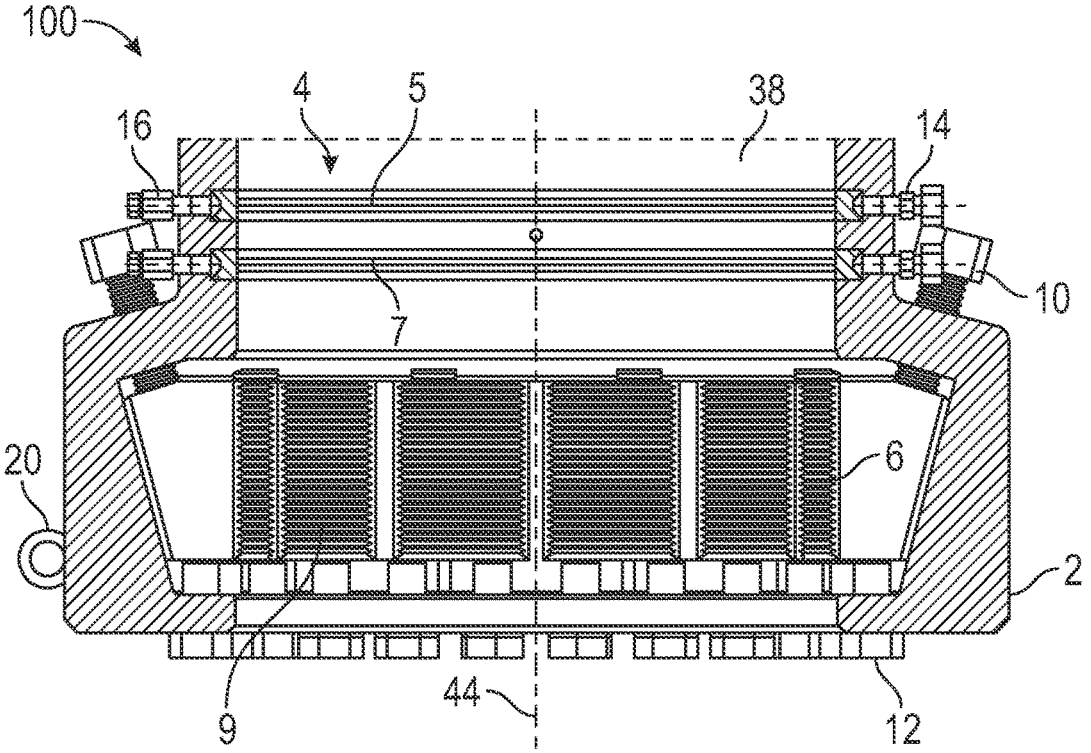
FIG. 2 is a sectional side view of a weldless adapter comprising seals with injections port and bleeder ports.
Figure 3:
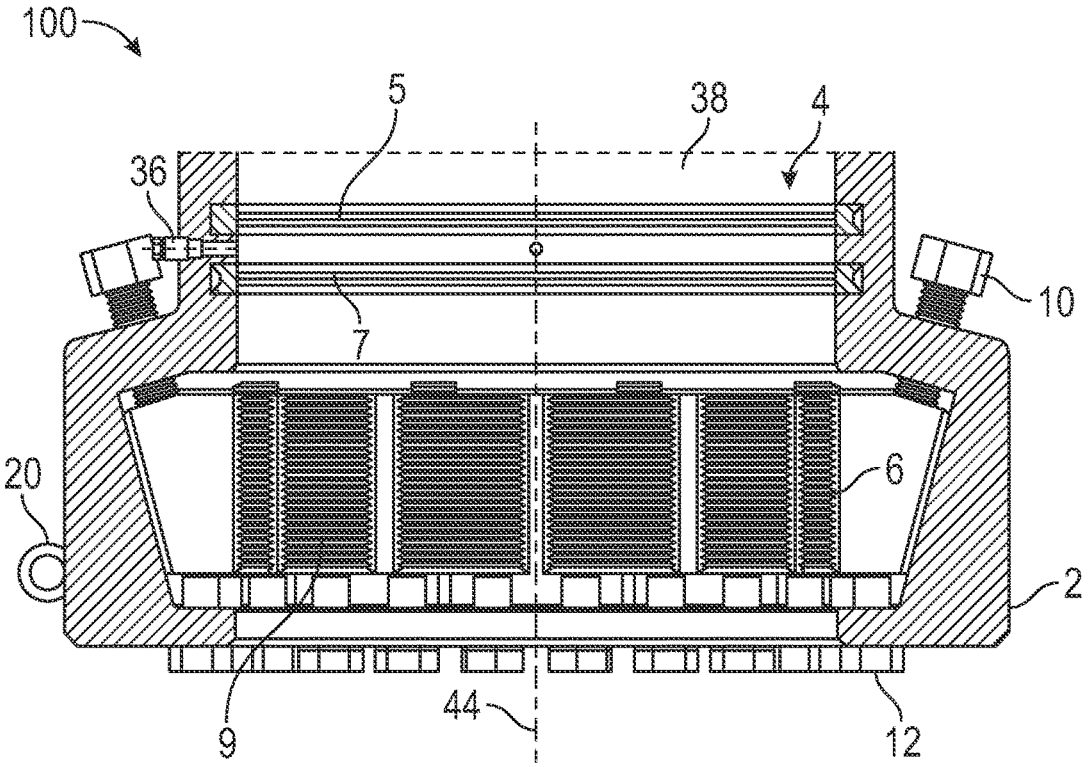
FIG. 3 is a sectional side view of a weldless adapter comprising seals with a test port.

Turning to FIGS. 2-3, a side sectional view of a weldless adapter 100 comprising seals 4 and injection 14, bleeder 16, and test 36 ports is shown in accord with one embodiment of the present invention.

Prior to the installation of the adapter 100 on the casing, inspection of the underside of the adapter 100 may be performed to ensure that all seals 4 are installed. The teeth 9 of the slip segments 6 may also be inspected to ensure that they are clean and free of any foreign metal particles that may have been deposited there from previous well operations.

If the seals 4 are not installed in the body of the adapter 100, inspection of the seal grooves or recesses 17 (FIGS. 1A and 6) may be completed to ensure they are clean of any foreign material. The seals 4 may be lubricated with a light application of oil or grease. Installation of the rubber seals 4 may be completed with a rubber mallet, rubber hammer, or other suitable device. Use of a metal hammer could damage the rubber seals 4. In a preferred method, installation should start with the lowest seal ring 7 and move upward, concluding with the top seal ring 5.

Grease injection fittings may be installed in N.P.T. openings within body 2 for injection ports 14. Plugs (not shown) are installed on the test ports 36. Ball check fittings, with vent port holes, may be installed in the bleeder ports 16. Additional plugs (not shown) may be fitted onto injection ports 14 and bleeder ports 16.

The seals 4 may be energized with a grease gun or other suitable grease injection pump by pumping or injecting grease into the injector port 14 for the top seal. The relief or bleed fitting 16 for that seal should be in the "open" position.

When returns are observed through the appropriate relief port 16 the relief port 16 may be dosed while continuing to pump grease into the seal 4 until a continuous pressure of approximately 1500 PSI is reached. The appropriate pressure may vary more or less depending on the desired application. The grease gun or other like device may be removed from upper seal 5 and the procedure repeated on the lower seal 7 to energize both seals 4.

After both seals 4 have been energized, a test pressure can then be applied into test port 36 between the two seals 4. The pressure from the seals assists in clamping the adapter 100 onto the conductor casing 42. For this purpose, grease can be injected into the test port 36. The test pressure may be approximately 1000 PSI between the seals 4. If the test pressure cannot be maintained, check the grease pressure on the seals 4 to ensure that the previously applied pressure is still holding on the seals 4. Repressurize the seals 4 with grease if necessary and retest.

If the test pressure cannot be maintained, recheck the grease pressure in all seals 4. If the grease pressure is low, repressurize the seals 4 with grease. Reapplication of the test pressure can then verify whether the proper pressure can be maintained between the seals 4. If the seals 4 will not hold test pressure, the weldless adapter 100 should be removed from the pipe and all damaged seals 4 should be replaced.

Figure 4:
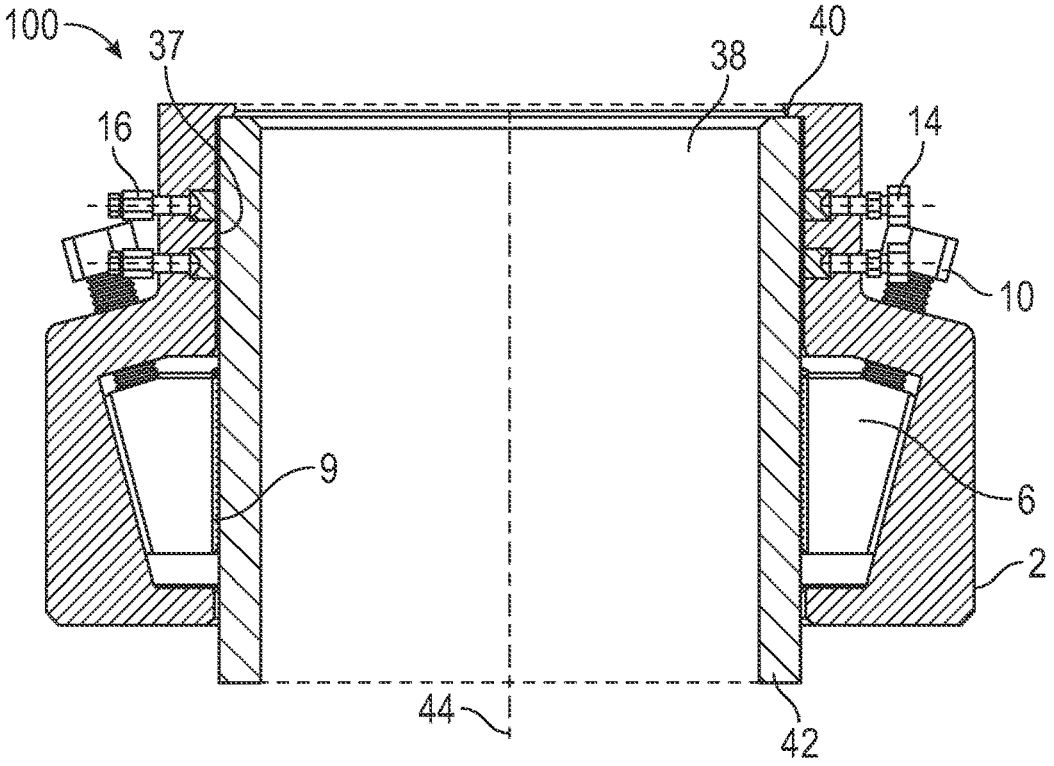
FIG. 4 is a sectional side view of a weldless adapter with slip retainers shown in accord with one embodiment of the present invention.
Figure 5:
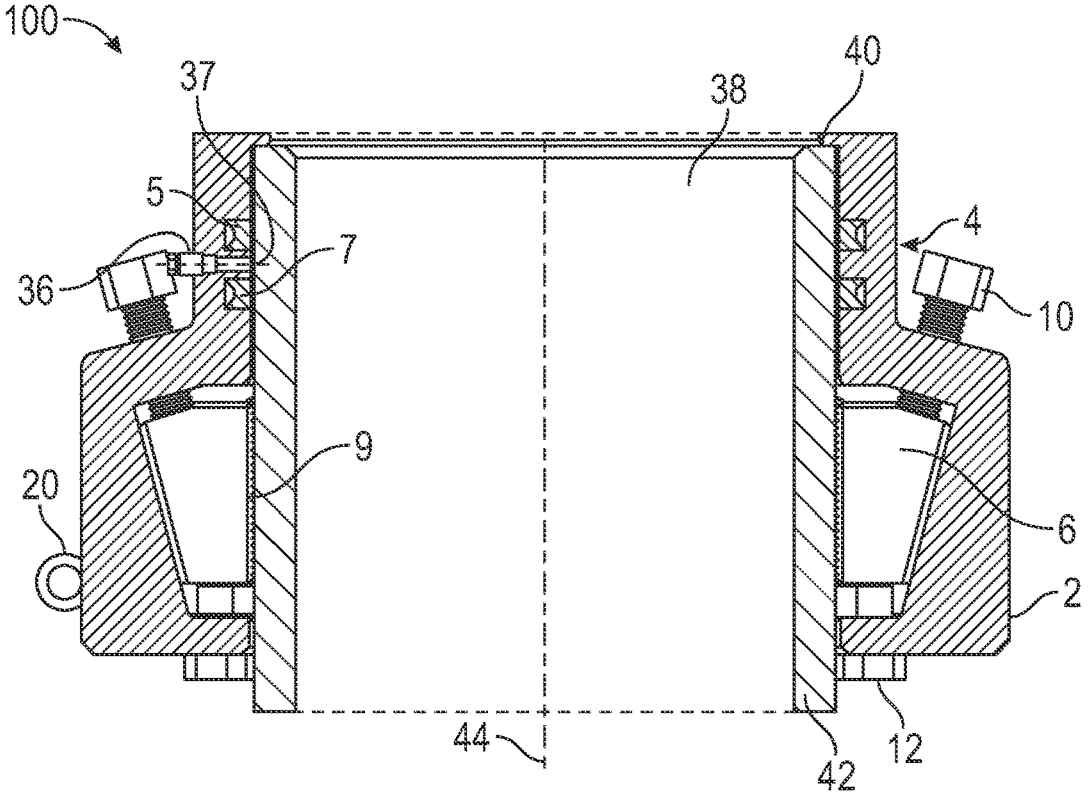
FIG. 5 is a sectional side view of a weldless adapter with slip retainers shown in accord with one embodiment of the present invention.

Now turning to FIGS. 4-5, a side sectional view of weldless adapter with slip retainers 6 is shown in accord with one embodiment of the present invention. In a preferred embodiment, prior to install of weldless adapter 100 all slip segments 6 should be placed in the fully retracted (UP) position. In some embodiments, a diverter may be installed with the adapter over the casing prior to installing the weldless adapter 100 on the conductor casing 42. The adapter 100 should be completely down over the casing 42 with the top of the casing resting on the mating shoulder 40 of the adapter body 2.

In a preferred embodiment, the slip actuator bolts 10 may then be tightened at 12 o'clock, 6 o'clock, 3 o'clock and 9 o'clock positions (as viewed from the top). The distance from the casing O.D. to the adapter bottom I.D. may then be measured to ensure that the adapter is centered over the casing (±1/16"). The distance may vary depending on the application and can be larger or smaller than 1/16". This dimension should be taken or measured in line with the slip actuator bolts 10. If the dimension at all four points is not equal, tighten the slip actuator bolt 10 on the side with the smaller dimension until the adapter 100 is centered with the casing 42 and all dimensions are equal along axis 44.

The four actuator bolts 10 may be tightened to approximately "1000 foot-pounds" of torque. The actual torque requirement may vary depending on a plurality of factors such as pressure, metal type, or the like. The dimensions on the actuator bolts 10 should be inspected to make sure that the weldless adapter 100 is still centered over the casing 42. After the torque and dimensions have been verified, the remaining actuator bolts 10 may be evenly tightened to approximately to "800-1000 foot-pounds" of torque. The slips should be secured in place as shown in FIG. 4. After the slip actuator bolts have been uniformly tightened, the seals 4 are ready to be energized as described above.

In FIG. 5, the jack up screws 12 may be utilized to engage the slips 6 upwards thereby pushing or engaging slips 6 to bite or latch to the conductor casing 42. The slip teeth 9 are driven into the conductor casing 42 as the slips 6 are pushed further upward by the jack up screws 12 to firmly latch into place and ensure the adapter 100 remains in proper position.

Annulus 37 is formed between adapter 100 and conductor casing 42 and allows for fluid movement during operations. After both seals 4 have been energized, a test pressure can then be applied into test port 36 between the two seals 4. The pressure from the seals assists in clamping the adapter 100 onto the conductor casing 42. The seals 4 prevent fluid from flowing through the annulus. A test pressure is injected between the upper seal 5 and lower seal 7, collectively seals 4, to ensure the required seal pressure is maintained and each seal is operating satisfactorily. If the seals 4 will not hold test pressure, the weldless adapter 100 should be removed from the pipe and all damaged seals 4 should be replaced.

Figure 6:
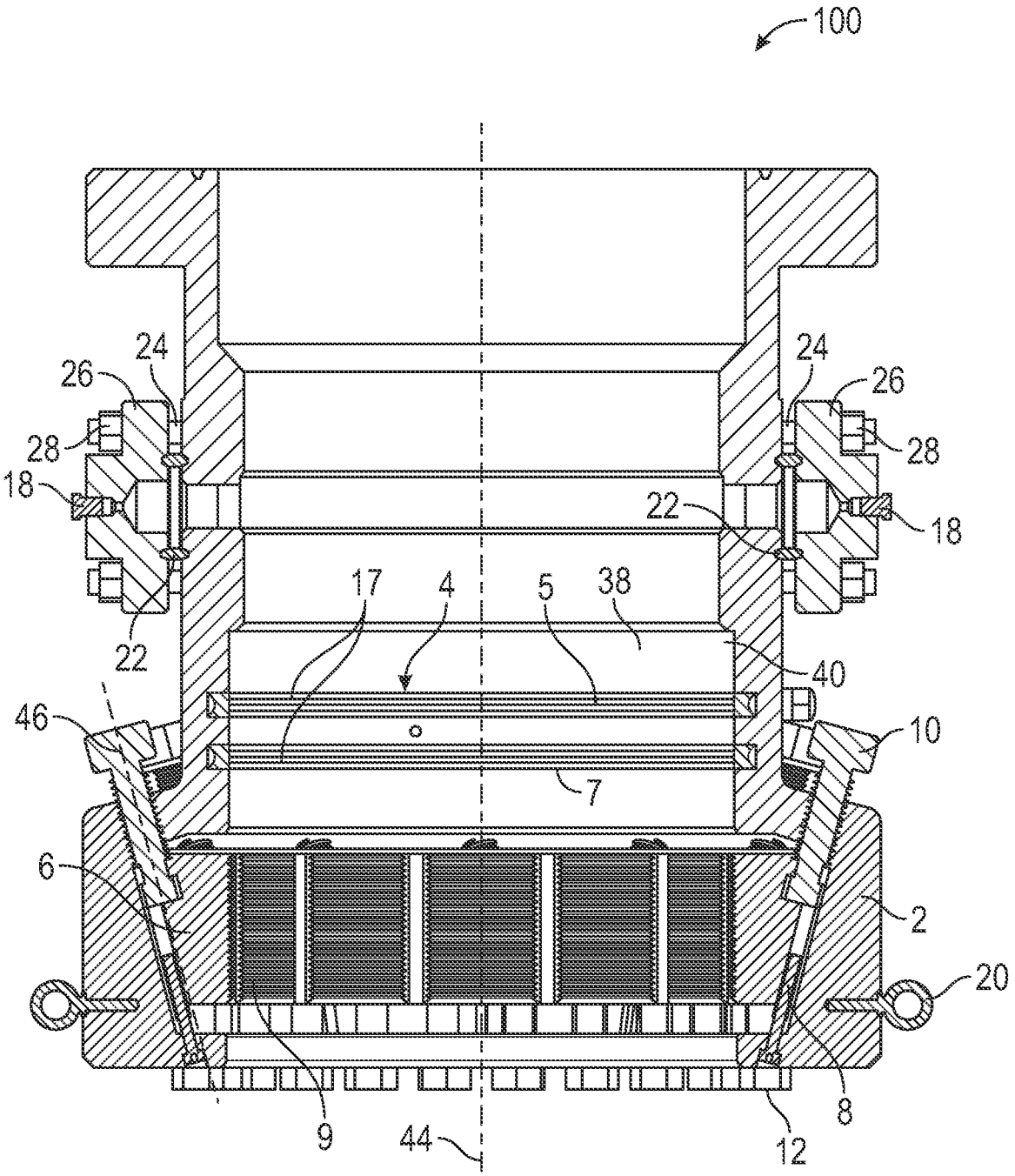
FIG. 6 is a sectional side view of an assembled weldless adapter.
Figure 7:
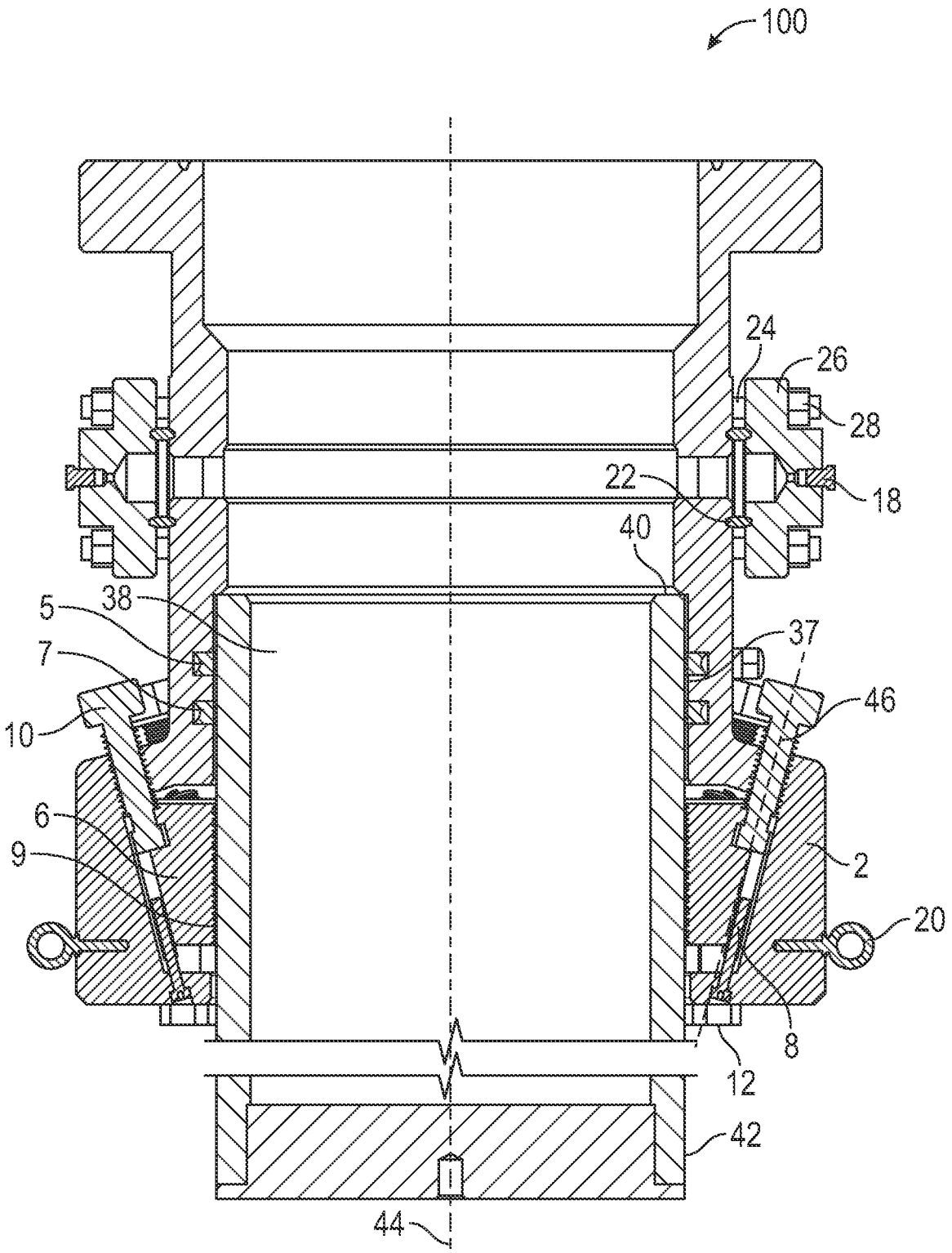
FIG. 7 is a sectional side view of a weldless adapter mounted on a conductor casing.

Turning to FIGS. 6-7, weldless adapter 100 can be seen fully assembled but unmounted on conductor casing 42 and then also fully mounted. In FIG. 6, adaptor 100 is ready to be lowered onto a conductor casing using the procedures supra to align the adapter and slips relative to the casing and then latch or bite into the conductor casing. In FIG. 7, the conductor casing can be seen with the adapter mounted onto casing 42. The adapter 100 comprises a shoulder 40 internally formed to engage the conductor casing 42. Once the slips are tightened, the seals 4 may be energized to further buttress the adapter securely on the conductor casing and create a positive seal between the adapter and the casing.

One of the advantages of utilizing a weldless adapter is the decreased amount of time to deploy the adapter. Another advantage is decreased time for engaging or disengaging the adapter for moving it from one conductor casing location to another. Accordingly, after the adapter 100 is mounted and finishing any pressure testing or initial drilling operations, the weldless adapter may be moved to another location.

The weldless adapter may be removed from the conductor pipe by first releasing the grease pressure from the upper and lower seals 5,7 by opening the two relief ports 16 (as can be seen in FIG. 4' The jacking bolts 12 may then be installed in the threaded holes beneath the slip segments 6. The slip actuator bolts 10 may be rotated counterclockwise. The actuator bolts 10 will loosen and then tighten back up. This will allow room between the head of the slip actuator bolt 10 and the slip 6. The jacking bolts 12 may be further tightened to move the slips 6 up slightly. The slip segments 6 will stop against the head of the slip actuator bolts 10. This initial movement may be enough to release the slip segments 6 from the conductor pipe 42.

To further loosen the adapter 100, the slip actuator bolts 10 may be rotated counterclockwise to move the slip segments 6 to the fully retracted position. Check all actuator bolts 10 to make sure that all slip segments 6 are in the fully retracted position. This check can be done by measuring the length of the actuator bolt 10 protruding above the adaptor body 2.

Pressure may then be applied to the test port 36 which will loosen the seals 4 contact with the conductor pipe 42. The eye bolts 20 may be attached to and used to pull on the bolts 20 perpendicular to the connector. This will also loosen the seals against the conductor pipe. After all slip segments 6 are fully retracted and seals 4 released, the adapter 100 may be lifted and removed from the casing 42 for inspection, service, redeployment, or the like.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention. Moreover, the scope of this patent is not limited to its literal terms but instead embraces all equivalents to the claims described.

The invention claimed is:

1. A weldless adapter operable for attachment to a conductor casing comprising:

an adapter body, said adapter body defining a bore therethrough;

said adapter body defining a slip cavity;

a plurality of slip segments mounted within said slip cavity positioned for engagement with said conductor casing;

said adapter body further defining two seal recesses;

two seals mounted in said two seal recesses whereby said two seals are positioned to seal around said conductor casing;

said adapter body further defining two injection ports in fluid communication with said two seal recesses;

two injection fittings mounted in said two injection ports, said two injection ports being operable to receive pressurized grease, said two seals being responsive to said grease to energize said two seals for sealing around said conductor casing;

said adapter body further defining a test port positioned between said two seals, said test port being in communication with an annulus formed between said two seals and said conductor casing when said adapter body is mounted to said conductor casing;

a test fitting mounted to said test port;

said adapter body defining a first plurality of openings that are above said slip cavity when said adapter body is mounted for operation, said first plurality of openings leading to said slip cavity;

a first plurality of threaded fasteners positioned within said first plurality of openings that engage said slip segments;

said first plurality of openings comprising a first plurality of axes that are at an acute angle with respect to a bore axis that goes through said bore.

2. The weldless adapter of claim 1 further comprising said test port being operable for receiving pressurized grease between said two seals to provide a pressurized test of said two seals, said adapter body defining a second plurality of openings below said slip cavity, said second plurality of openings comprising a second plurality of axes that are parallel to said bore axis, a second plurality of threaded fasteners positioned within said second plurality of openings, said second plurality of threaded fasteners directly engaging said slip segments.

3. The weldless adapter of claim 1, further comprising said slip segments being constructed with teeth along an inner wall of said slip segments relative said adapter body, said teeth biting into said conductor casing when latching said weldless adapter to said conductor casing and retracting when releasing said weldless adapter from said conductor casing.

4. The weldless adapter of claim 1 further comprising a third plurality of threaded fasteners that are oriented at said acute angle, said third plurality of threaded fasteners being offset from said first plurality of threaded fasteners.

5. The weldless adapter of claim 1, further comprising said adapter body defining two bleeder ports in fluid communication with said two seal recesses, and two bleeder fittings mounted to said two bleeder ports, said two bleeder ports being operable for bleeding grease from said two seal recesses.

6. A method of providing a weldless adapter operable for attachment to a conductor casing, comprising:

mounting an adapter body onto said conductor casing;

injecting grease into a first groove to activate a first seal ring around said conductor casing and at least temporarily allowing grease to bleed out of said first groove through a first bleeder port;

injecting grease into a second groove to activate a second seal ring around said conductor casing and at least temporarily allowing grease to bleed out of said second groove through a second bleeder port;

injecting grease into an annulus between said first seal ring and said second seal ring to test said first seal ring and said second seal ring, said adapter body defining a bore therethrough along a bore axis;

mounting a plurality of slip segments within a slip cavity within said adapter body, said slip cavity extending outwardly from said bore;

engaging said plurality of slip segments with a first plurality of threaded fasteners that extend from a position above said plurality of slip segments; and directly engaging said plurality of slip segments with a second plurality of threaded fasteners that extend from a position below said plurality of slip segments.

7. The method of claim 6, further comprising supporting said adapter body on said conductor casing on a shoulder formed within said adapter body and moving said first plurality of threaded fasteners along a first plurality of axes that are at an acute angle with respect to said bore axis, providing that said first plurality of threaded fasteners directly engage said plurality of slip segments.

8. The method of claim 6, further comprising engaging said plurality of slip segments with a third plurality of threaded fasteners mounted between said first plurality of threaded fasteners and said second plurality of threaded fasteners and providing that each of said third plurality of threaded fasteners are oriented at an acute angle with respect to said bore axis.

9. The method of claim 7, further comprising utilizing at least one of said first plurality of threaded fasteners or said second plurality of threaded fasteners for centralizing said adapter body on said conductor casing.

10. The method of claim 6, further comprising measuring pressure at said first groove, measuring pressure at said second groove, and measuring pressure at said annulus for said test of said first seal ring and said second seal ring.

11. The method of claim 7, further comprising utilizing each of said first plurality of threaded fasteners to apply a force at an acute angle with respect to said bore axis to selectively push said plurality of slip segments toward conductor casing or to pull said plurality of slips away from said conductor casing.

12. A weldless adapter operable for attachment to a conductor casing, comprising:

an adapter body;

a plurality of slip segments mounted in the adapter body;

a first plurality of threaded fasteners along a periphery of said adapter body that extend from above said plurality of slips when said adapter body is in an upright position, said first plurality of threaded fasteners directly engage an upper portion of said plurality of slip segments;

a second plurality of threaded fasteners mounted to directly engage a lower portion of said plurality of slip segments;

said adapter body defining two seal recesses, two seals mounted in said two seal recesses whereby said two seals are positioned to seal around said conductor casing;

said adapter body defining two injection ports in fluid communication with said two seal recesses;

two injection fittings mounted in said two injection ports, said two injection ports being operable to receive pressurized grease, said two seals being responsive to said pressurized grease to energize said two seals for sealing around said conductor casing;

two bleeder ports being operable to bleed off grease from said two seal recesses;

said adapter body defining a test port positioned between said two seals, said test port being in communication with an annulus formed between said two seals and said conductor casing; and a test fitting mounted to said test port.

13. The weldless adapter of claim 12, further comprising, a third plurality of threaded fasteners mounted to directly engage said plurality of slip segments, said third plurality of threaded fasteners being positioned between said first plurality of threaded fasteners and said second plurality of threaded fasteners.

14. The weldless adapter of claim 12, further comprising said plurality of slip segments being constructed with teeth on an inner side of said plurality of slip segments relative to said adapter body for engagement with said conductor casing, said adapter body defining a bore therethrough with a bore axis, said first plurality of threaded fasteners being oriented at an acute angle with respect to said bore axis, said second plurality of threaded fasteners being oriented parallel to said bore axis.

15. The weldless adapter of claim 12, further comprising said adapter body defining a bore therethrough, said bore defining a bore axis, each of said first plurality of threaded fasteners being oriented at an acute angel with respect to said bore axis; and said second plurality of threaded fasteners being operable for axial movement parallel to said bore axis.

16. The weldless adapter of claim 13, further comprising said third plurality of threaded fasteners each being oriented at an acute angle with respect to a bore axis through said adapter body.

* * * * *